US011952744B2

(12) United States Patent
Richard et al.

(10) Patent No.: US 11,952,744 B2
(45) Date of Patent: Apr. 9, 2024

(54) DITCH FORMING APPARATUS

(71) Applicant: Crary Industries, Inc., West Fargo, ND (US)

(72) Inventors: Benjamin T. Richard, Fargo, ND (US); Rachelle Radi, Fargo, ND (US)

(73) Assignee: Crary Industries, Inc., West Fargo, ND (US)

( * ) Notice: Subject to any disclaimer, the term of this patent is extended or adjusted under 35 U.S.C. 154(b) by 400 days.

(21) Appl. No.: 17/347,175

(22) Filed: Jun. 14, 2021

(65) Prior Publication Data

US 2022/0396929 A1 Dec. 15, 2022

(51) Int. Cl.
*E02F 5/08* (2006.01)
*E02F 5/14* (2006.01)

(52) U.S. Cl.
CPC ..... *E02F 5/08* (2013.01); *E02F 5/145* (2013.01)

(58) Field of Classification Search
CPC ..... E02F 5/08; E02F 5/145
See application file for complete search history.

(56) References Cited

U.S. PATENT DOCUMENTS

| | | | |
|---|---|---|---|
| 1,095,097 | A | 4/1914 | Fournet |
| 2,619,746 | A | 12/1952 | Heaman |
| 2,708,798 | A | 5/1955 | Warner et al. |
| 2,965,985 | A | 12/1960 | Sillasen et al. |
| 3,314,175 | A | 4/1967 | Petty et al. |
| 3,624,826 | A | 11/1971 | Rogers |
| 3,690,023 | A | 9/1972 | Peterson |
| 5,113,610 | A | 5/1992 | Liebrecht, Jr. |
| 5,190,140 | A | 3/1993 | Buschbom |
| 5,511,326 | A | 4/1996 | Liebrecht, Jr. |
| 5,864,970 | A | 2/1999 | Maddock et al. |
| 6,226,903 | B1 | 5/2001 | Erickson |
| 6,341,435 | B1 | 1/2002 | Erickson |
| 6,418,647 | B1 | 7/2002 | Erickson |
| 6,536,140 | B2 | 3/2003 | Vaags et al. |
| 7,627,964 | B2 | 12/2009 | Vaags et al. |
| 9,374,938 | B2 | 6/2016 | Thompson |
| 10,550,544 | B1 * | 2/2020 | Erickson ..... A01B 49/027 |

* cited by examiner

*Primary Examiner* — Tara Mayo
(74) *Attorney, Agent, or Firm* — Wood, Phillips, Katz, Clark & Mortimer

(57) ABSTRACT

A ditch forming apparatus having: a frame; a primary ditch forming assembly having: a) a first subassembly for penetrating and separating subjacent ground material; and b) a second subassembly for directing separated ground material away from a ditch being formed; and a ground treatment assembly to facilitate delivery of ground material to the second subassembly and having a ground engaging component that is turned around a first axis. At least one of: a) a vertical height of the first axis relative to the frame; b) a variable vertical force generated between the at least one ground engaging component and frame; c) a fore and aft position of the first axis relative to the frame; d) a speed of turning of the at least one ground engaging component around the first axis; and e) a direction of turning of the at least one ground engaging component around the first axis, can be changed.

22 Claims, 12 Drawing Sheets

DITCH FORMING APPARATUS

BACKGROUND OF THE INVENTION

Field of the Invention

This invention relates to ditch forming apparatus and, more particularly, to a ditch forming apparatus that is movable to continuously form a ditch while depositing removed ground material and debris laterally away from the ditch.

Background Art

Myriad ditch forming apparatus have been devised over the past several decades which are advanced to continuously cut and separate ground material and direct the separated ground material laterally away from the formed ditch. For purposes of simplicity herein, an apparatus will be identified as forming a ditch whether it functions to initially form a ditch, dress or enlarge a ditch, and/or remove debris that may have accumulated in an existing ditch. The precise nature of the ditch or its purpose are not critical in describing the existing and inventive technology herein.

In one exemplary form of ditch forming apparatus, a frame is drawn by a towing vehicle. The frame carries a scraping or shoveling unit that penetrates subjacent ground material to produce the desired cross-sectional shape of the ditch. The separated ground material is picked up by a downstream assembly that diverts the separated ground material laterally to the side of the ditch. The diversion may involve simple deflection of material or dispersion using a powered component.

To avoid the formation of a bank at the edge of the ditch, it is common that the downstream assembly is powered to propel the separated material so that it is distributed over a significant width dictated by the nature and propulsion capacity of the structure on the downstream assembly. Commonly, the material dispersing unit will consist of a rotary, bladed component that causes the separated material to be accelerated by, and centrifugally depart from, that component.

A relatively uniform distribution of the propelled ground material is realized with the ground material maintained in a loosened state and delivered to the rotating dispersing component at a relatively constant rate.

This uniform distribution of material is made difficult by different field conditions which make the transfer of the particular ground material to and from e rotating body inconsistent. For example, in damp conditions, compacted clods may be produced which result in spurts of large masses being propelled by the downstream assembly. Mixed-in debris introduces another level of inconsistency in flow rate of material to and from the rotating dispersion component. For example, a single location may have a mixture of muddy soil, loose soil, crop debris, and other extraneous matter.

To provide for a more consistent rate of transfer of the particular ground material, it is known to incorporate cross feeding structures, such as paddled devices or augers that are turned around an axis and tend to distribute the separated material laterally before being intercepted by the rotating dispersion component. One example of such a structure is shown in U.S. Pat. No. 6,418,647, to Erickson. Erickson uses a mixture of paddle configurations that are rotated about a laterally extending axis to assist both lateral distribution and front-to-rear conveyance of ground material to be picked up by a rotating dispersing member.

Typically, the cross feed structure is in a fixed relationship to the remainder of the ditch forming structure with which it cooperates. As such, the the overall structure may operate with different levels of effectiveness, and potentially experience different difficulties, based upon the conditions of the underlying terrain and the precise nature of the ditch in terms of its width and depth. For example, for a relatively deep ditch, the cross feeding structure may also be required to penetrate the subjacent ground to a substantial depth. Thus, significant resistance to operation may be encountered, which is further aggravated by certain soil conditions, such as those where clay or a high level of moisture are present. As a result, a substantially greater amount of power may be required to operate the overall apparatus. Further, the deep penetration by the cross feed structure may lead to significantly increased stress on components thereof which may lead to premature failure of both ground engaging components and associated components responsible for effecting the driving thereof.

Generally designs are arrived at that are considered to be universal in nature whereas they do not perform the same in different field conditions. For example, a cross feed structure may be less effective in clay conditions the further forward it is situated relative to the rotary dispersion member. On the other hand, heavy crop debris is generally handled more effectively by having the cross feed structure situated further forwardly relative to the rotary dispersion member.

Another problem with existing designs is that the downstream dispersion assembly and the cross feed structure are generally in close enough proximity that maintenance in the region therebetween is often inconvenient. The conventional design typically leaves a relatively small gap in which access to the components on the rotary dispersion member and cross feed structure, typically requiring maintenance, can be gained. Thus, either needed maintenance or upkeep may be delayed or disassembly of numerous components may be required to carry out such maintenance, with the latter introducing additional labor requirements and downtime. Even access required to simply remove lodged material may be made difficult by the close proximity of the components on the rotary dispersion member and the cross feed structure. Typically, the only way to dislodge the material is to physically access the region of concern with the apparatus shut down.

The industry continues to seek out designs of ditch forming apparatus that address some or all of the above limitations in the existing technology.

SUMMARY OF THE INVENTION

In one form, the invention is directed to a ditch forming apparatus having a front and rear. The ditch forming apparatus has: a frame; a primary ditch forming assembly; and a ground treatment assembly. The primary ditch forming assembly is on the frame and has: a) a first subassembly for penetrating and separating subjacent ground material; and b) a second subassembly for directing separated subjacent ground material away from a ditch formed by the primary ditch forming assembly as the frame is advanced in an operating path. The ground treatment assembly is on at least one of the frame and primary ditch forming assembly and is configured to facilitate delivery of separated subjacent ground material to the second subassembly. The ground treatment assembly has at least one ground engaging component that is turned around a first axis to thereby cause the at least one ground engaging component to treat subjacent ground material delivered to the second subassembly. The ditch forming apparatus is configured so that at least one of: a) a vertical height of the first axis relative to the frame can be changed; b) a variable vertical force generated between the at least one ground engaging component and frame can be changed; c) a fore and aft position of the first axis relative to the frame can be changed; d) a speed of turning of the at least one ground engaging component around the first axis can be changed; and e) a direction of turning of the at least one ground engaging component around the first axis can be changed.

In one form, the ground treatment assembly has a shaft supporting the at least one ground engaging component and movable around the first axis. The at least one ground engaging component is configured to laterally advance engaged ground material as the shaft turns around the first axis.

In one form, the ground treatment assembly has a shaft supporting the at least one ground engaging component and movable around the first axis. The at least one ground engaging component is configured to reposition separated subjacent ground material delivered to the second subassembly.

In one form, the second subassembly has a first body rotatable around a second axis. A plurality of blades on the body, spaced radially from the second axis, direct ground material separated by the first subassembly laterally away from a ditch generated by the ditch forming apparatus as the frame is advanced in the operating path.

In one form, the second axis extends in a fore and aft direction and resides above the first axis where the first and second axis cross as viewed from above the ditch forming apparatus.

In one form, the shaft is mounted on a subframe. The subframe is mounted for guided movement relative to the frame over a range between a first position and a second position. A fore and aft location of the shaft relative to the frame changes as the subframe moves between the first and second positions.

In one form, a drive acts between the frame and subframe and is operable to change the subframe between the first and second positions.

In one form, the drive is an hydraulic drive.

In one form, the shaft is connected to at least one arm whereby the shaft and the at least one arm make up an arm assembly. The arm assembly is pivotably connected to at least one of: a) the frame; and b) a subframe on the frame for movement around another axis in a range between first and second positions. The shaft is at a first height relative to the frame with the shaft assembly in its first position and at a second height relative to the frame that is different than the first height with the shaft assembly in its second position.

In one form, a drive acts between at least one of the frame and subframe and the arm assembly and is operable to change the arm assembly between its first and second positions.

In one form, the drive is an hydraulic drive.

In one form, the drive is operable to act against the arm assembly to cause a variable downward force to be generated between the at least one ground engaging component and ground material as the ditch forming apparatus is operated.

In one form, the ditch forming apparatus has a drive for turning the shaft around the first axis. The drive is configured to turn the first shaft at different speeds around the first axis.

In one form, the ditch forming apparatus has a drive for turning the shaft around the first axis. The drive is configured to selectively turn the first shaft in opposite directions around the first axis.

In one form, the ditch forming apparatus has a drive for turning the shaft around the first axis. The drive is configured so that a speed of turning the shaft around the first axis can be changed whereby the speed of turning the shaft around the first axis can be changed with the body rotating around the second axis at a constant same speed.

In one form, the ditch forming apparatus is configured so that the drive can be controlled so that the shaft is not turned around the first axis with the body continuing to turn around the second axis.

In one form, a force applying structure acts between at least one of the frame and subframe and the arm assembly to thereby bias the at least one ground engaging component downwardly against subjacent ground material.

In one form, the ditch forming apparatus is provided in combination with a vehicle for towing the ditch forming apparatus and causing the frame to be advanced in the operating path.

In one form, the frame is supported on at least one wheel. The wheel is mounted movably relative to the frame so that a height of a portion of the frame at which the first subassembly is located can be changed relative to subjacent ground on which the ditch forming apparatus is supported.

In one form, the ditch forming apparatus is provided in combination with a towing vehicle for the frame and having a power takeoff. The ditch forming apparatus has at least one drive for turning the shaft around the first axis and the body around the second axis. The at least one drive is an hydraulic drive operated through the power takeoff on the towing vehicle.

BRIEF DESCRIPTION OF THE DRAWINGS

FIG. 3 is a side elevation view of the ditch forming apparatus in

FIG. 2;

DETAILED DESCRIPTION OF THE PREFERRED EMBODIMENT

Figure 1:
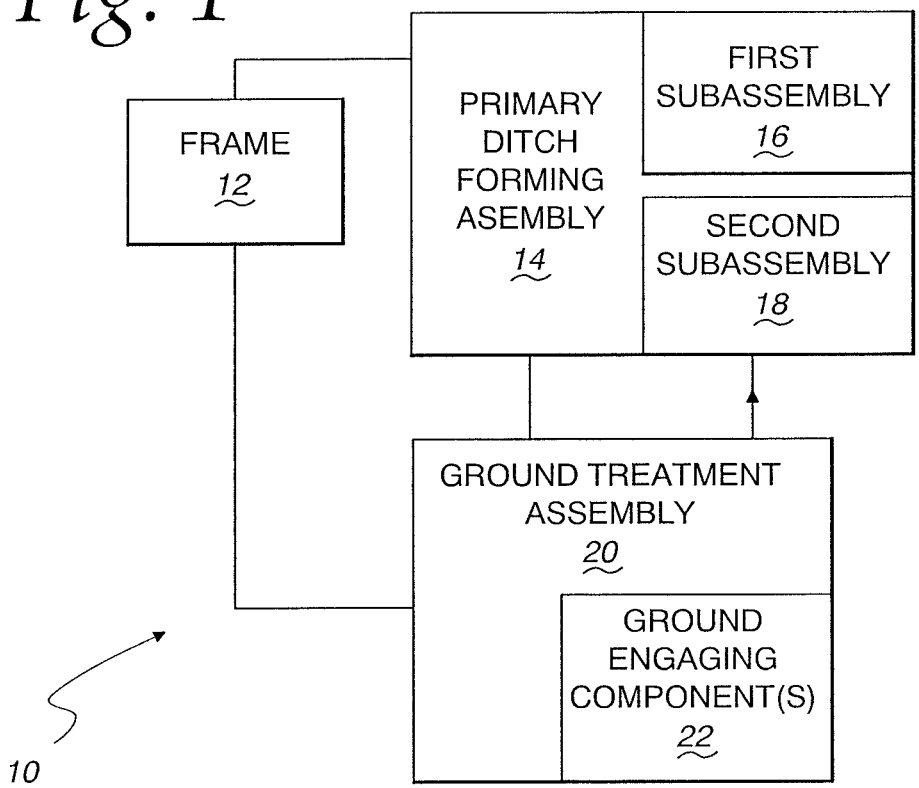
FIG. 1 is a schematic representation of a ditch forming apparatus, according to the present invention.

In FIG. 1, a ditch forming apparatus, according to the present invention, is shown schematically at 10. The ditch forming apparatus 10 has a frame 12 and a primary ditch forming assembly 14 on the frame 12. The primary ditch forming assembly 14 is made up of a first subassembly 16 for penetrating and separating subjacent ground material, and a second subassembly 18 for directing separated subjacent ground material away from a ditch formed by the primary ditch forming assembly 14 as the frame 12 is advanced in an operating path.

The ditch forming assembly 10 has a ground treatment assembly 20 on at least one of the frame 12 and primary ditch forming assembly 14 and configured to facilitate delivery of separated subjacent ground material to the second subassembly 18.

The ground treatment assembly has at least one ground engaging component 22 that is turned around a first axis to thereby cause the at least one ground engaging component 22 to treat subjacent ground material delivered to the second subassembly 18. As used herein, "treating" relates to any process performed by the component(s) 22 with respect to the material, be it breaking up the material, repositioning the material, routing the material, etc.

The schematic depiction of the components in FIG. 1 is intended to encompass virtually an unlimited number of variations of each of the components and their interaction. For example, the first subassembly 16 may be made up of any type of component that scrapes, cuts, accumulates, etc. ground material to produce a desired cross-sectional shape for a ditch being formed.

Similarly, the second subassembly 18 may be constructed so that the separated subjacent ground material may be diverted away from the ditch by simply being deflected by one or more components thereon as the frame 12 is advanced in the operating path. Alternatively, the second subassembly 18 may be made up of one or more movable components that are driven to propel the separated ground material as to effect somewhat uniform dispersion at the side of the ditch or for accumulation primarily at a selected, controllable distance laterally away from the ditch.

The ground engaging component(s) 22 may consist of a single component turned around an axis or multiple such components distributed and spaced around the axis and/or along the length thereof. For example, the component(s) 22 may be in the form of an auger, individual blades/paddles, or another type of configuration that is capable of carrying out the desired cross feeding function. If multiple paddles are used they may have the same construction or different constructions.

The ditch forming apparatus 10 depicted is configured so that at least one of: a) a vertical height of the first axis relative to the frame 12 can be changed; b) a variable vertical force generated between the at least one ground engaging component 22 and frame 12 can be changed; c) a fore-and-aft position of the first axis relative to the frame 12 can be changed; d) a speed of turning of the at least one ground engaging component 22 around the first axis can be changed; and e) a direction of turning of the at least one ground engaging component 22 around the first axis can be changed.

An exemplary form of ditch forming apparatus, consistent with the schematic showing in FIG. 1, will now be described with respect to FIGS. 2-13. It should be understood that the exemplary form should not be viewed as limiting, as it is but representative of the many different forms contemplated within the schematic showing of FIG. 1.

The ditch forming apparatus 10 has a front 24 and a rear 26. The frame 12 has a front connector 26 to engage a hitch 28 on a towing vehicle 30. In the depicted form, the towing vehicle 30 has a power takeoff 32 engaged with a rotary drive shaft 34. The ditch forming apparatus 10 is shown with an hydraulic input at 35.

Figure 14:
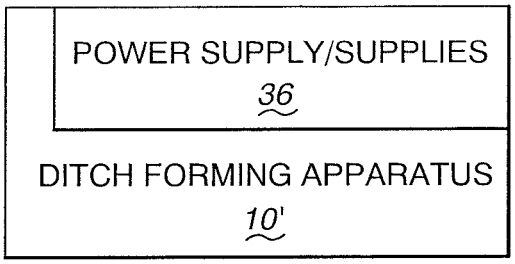
FIG. 14 is a schematic representation of a ditch forming apparatus, according to the present invention, with one or more power supplies for components thereon.

It should be noted that the ability to operate the components of the ditch forming apparatus through an hydraulic system is not required. As depicted schematically in FIG. 14, one form of ditch forming apparatus 10' may include one or more independent power supplies 36 for all components required to be driven in operation—hydraulically or otherwise.

In this embodiment, the primary ditch forming assembly 14 consists of the aforementioned first subassembly 16 and second subassembly 18.

The depicted form of the first subassembly 16 has side parts 38, 40 and bottom parts 42, 44 which cooperatively define a forwardly opening, U-shaped cutting edge 46 and bound a volume 47 matched to the desired shape of the particular ditch being formed/dressed. Gussets 48 are used for reinforcement of at least the side parts 38, 40.

The frame 12 is supported at its rear portion by a wheeled carriage 50, in this case consisting of laterally spaced wheels 52 and a subframe 54 which connects the wheels 52 to the frame 12.

Figure 2:
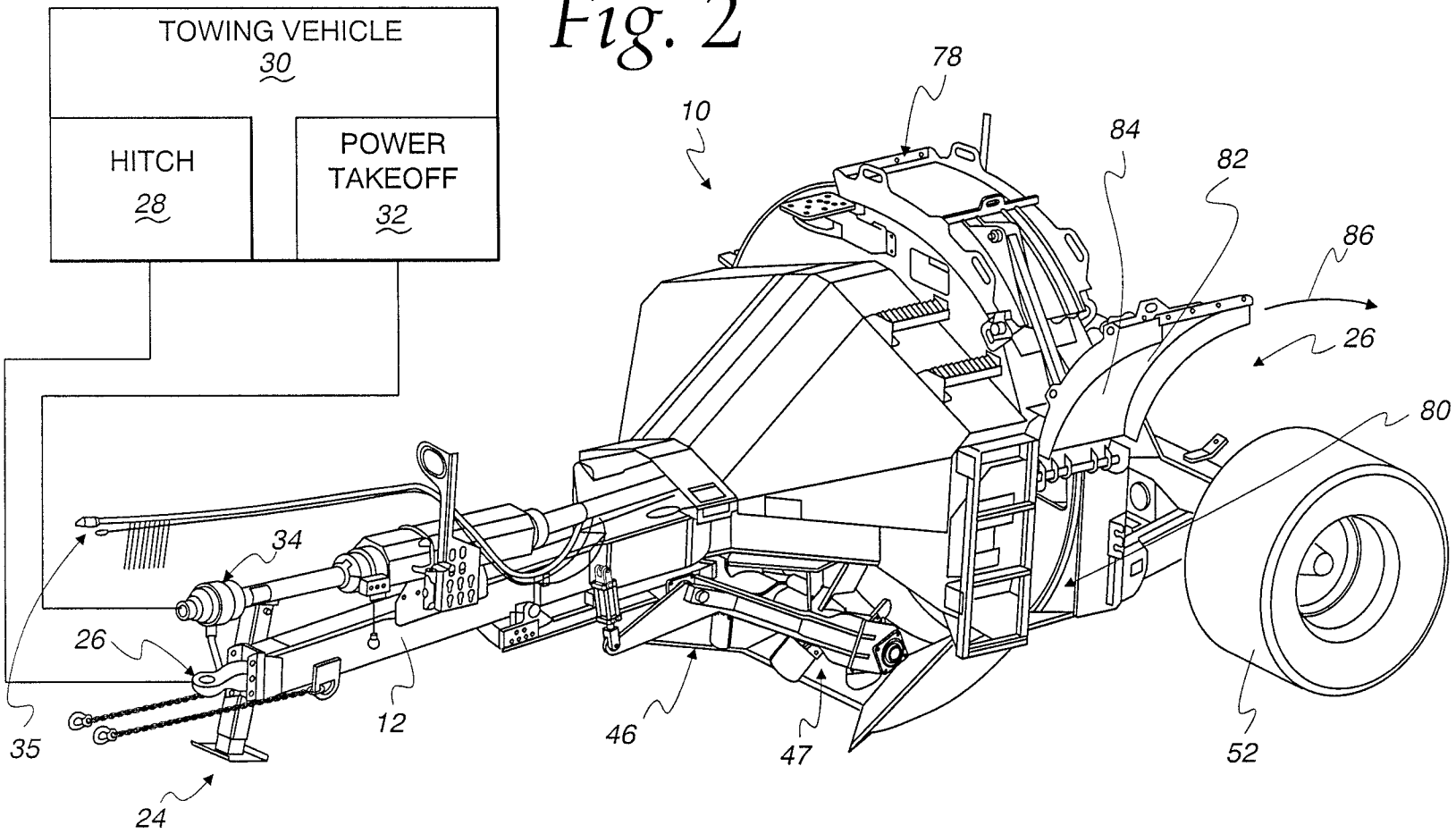
FIG. 2 is a perspective view of one exemplary form of ditch forming apparatus, as shown schematically in FIG. 1, with an associated towing vehicle therefor shown in schematic form.
Figure 3:
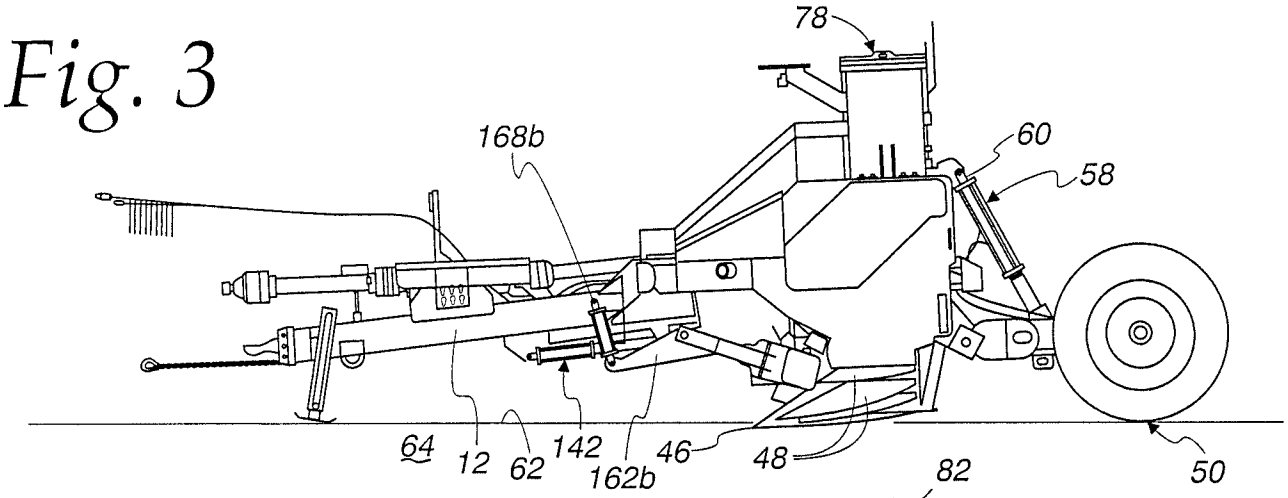
Figure 4:
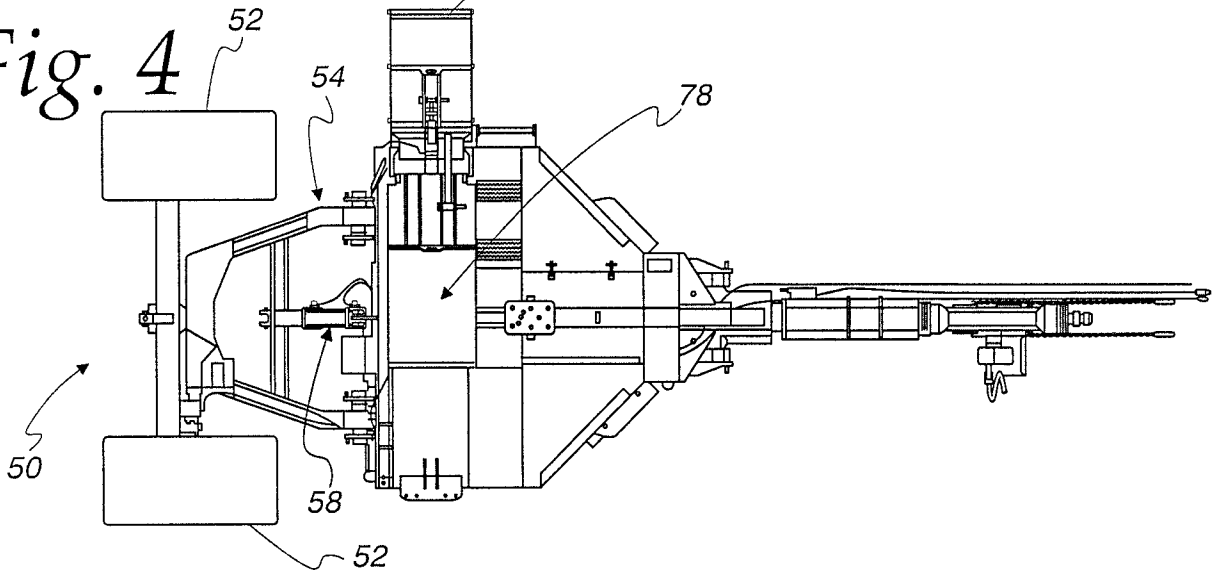
FIG. 4 is a plan view of the ditch forming apparatus shown in FIGS. 2 and 3.
Figure 5:
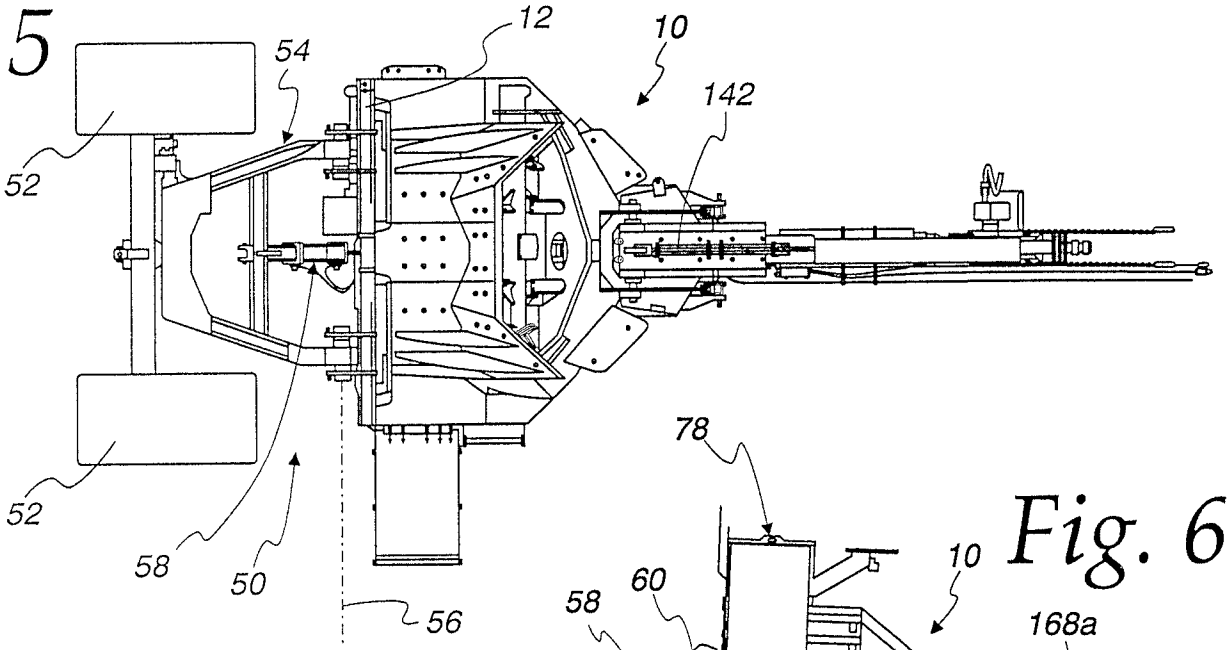
FIG. 5 is a bottom view of the ditch forming apparatus shown in FIGS. 2-4.
Figure 6:
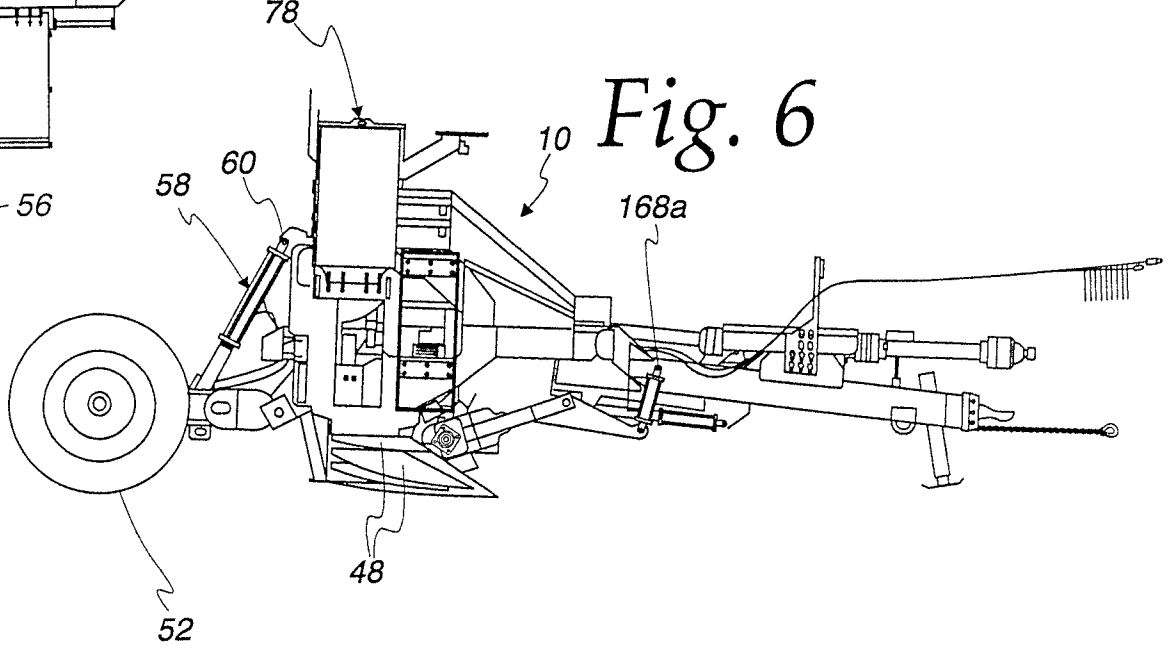
FIG. 6 is an elevation view of the ditch forming apparatus in FIGS. 2-5 taken from the side opposite that in FIG. 3.
Figure 7:
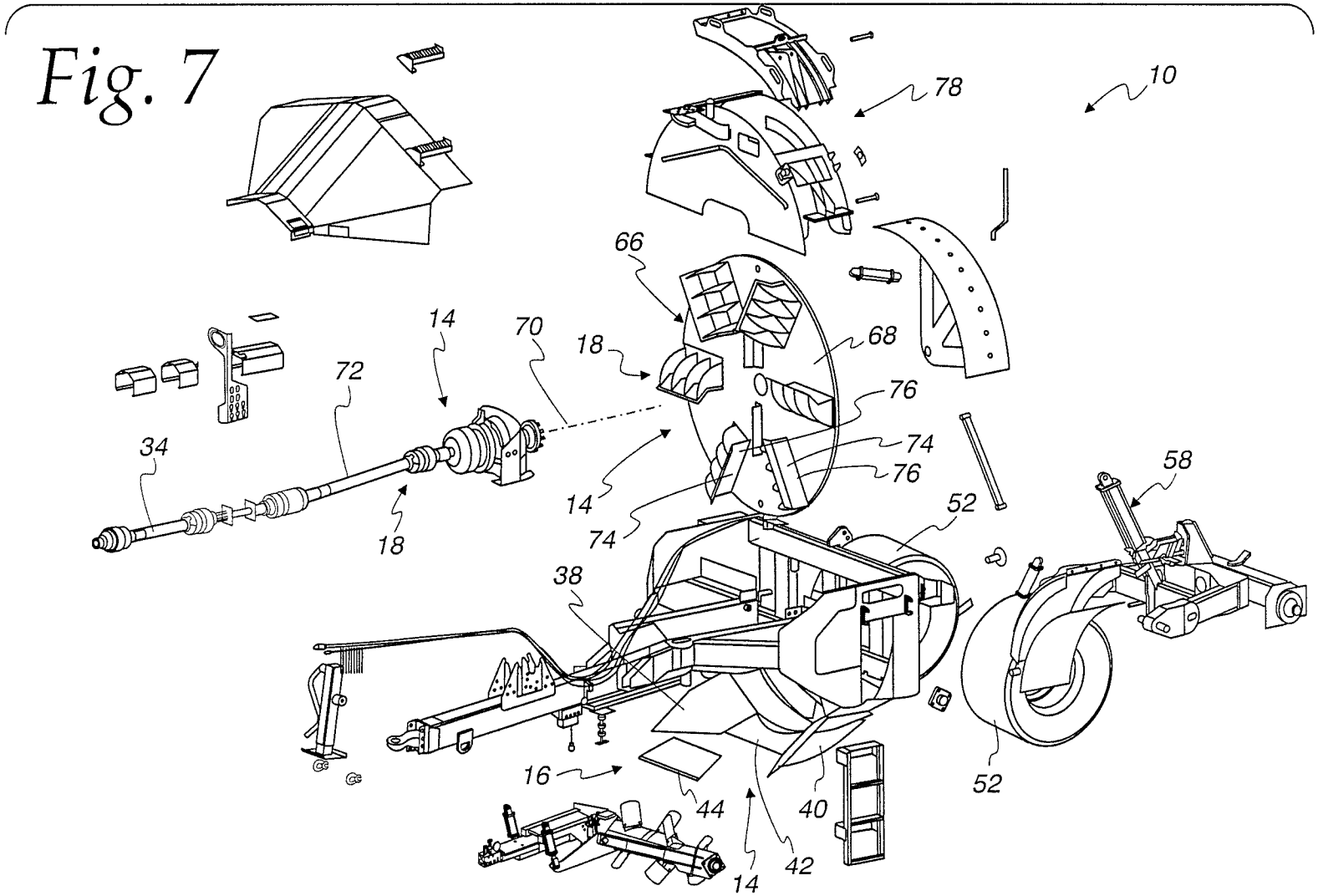
FIG. 7 is an exploded perspective view of the ditch forming apparatus shown in FIGS. 2-6.
Figure 8:
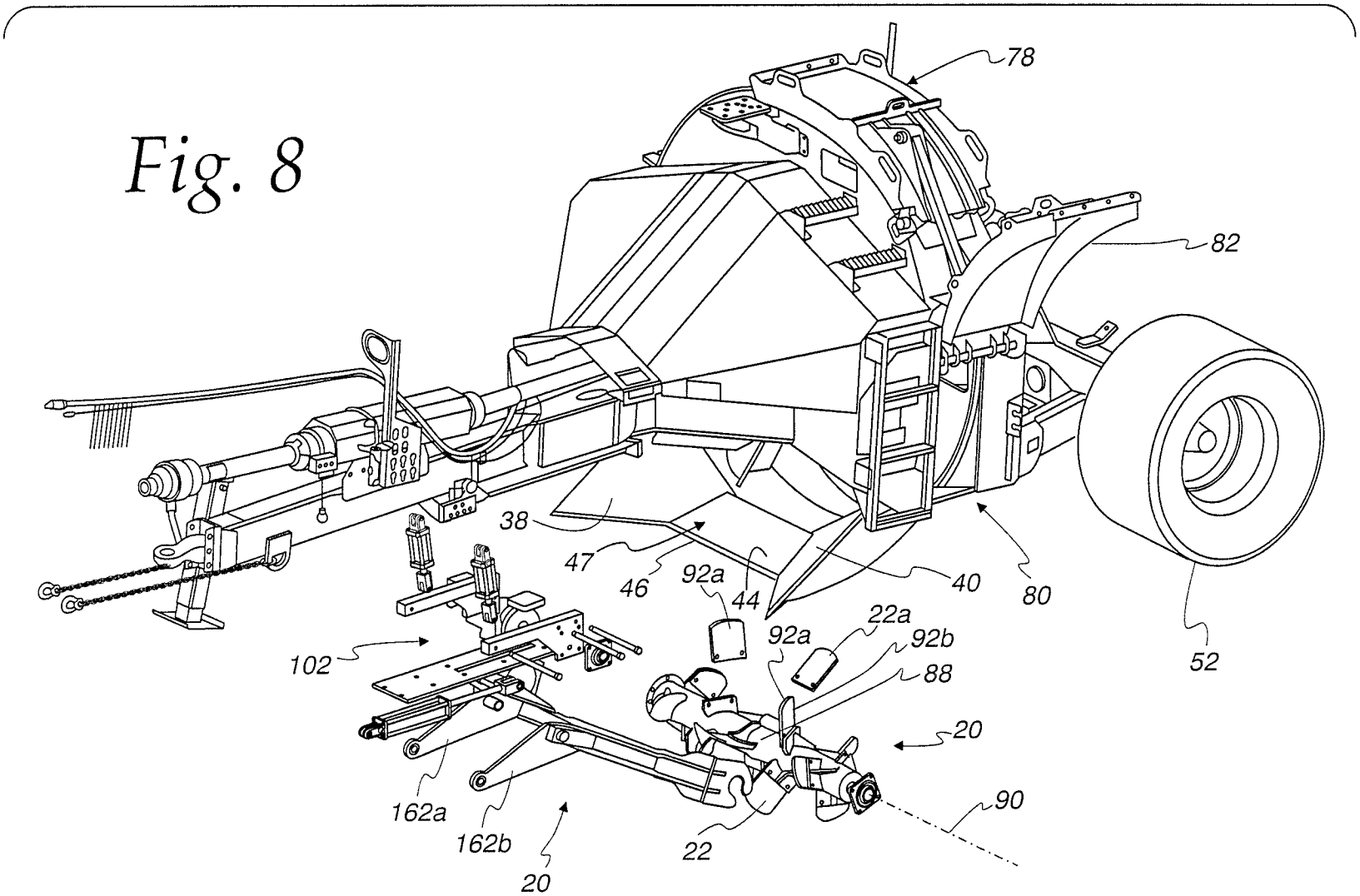
FIG. 8 is a partially exploded, perspective view of the ditch forming apparatus shown in FIGS. 2-7.
Figure 9:
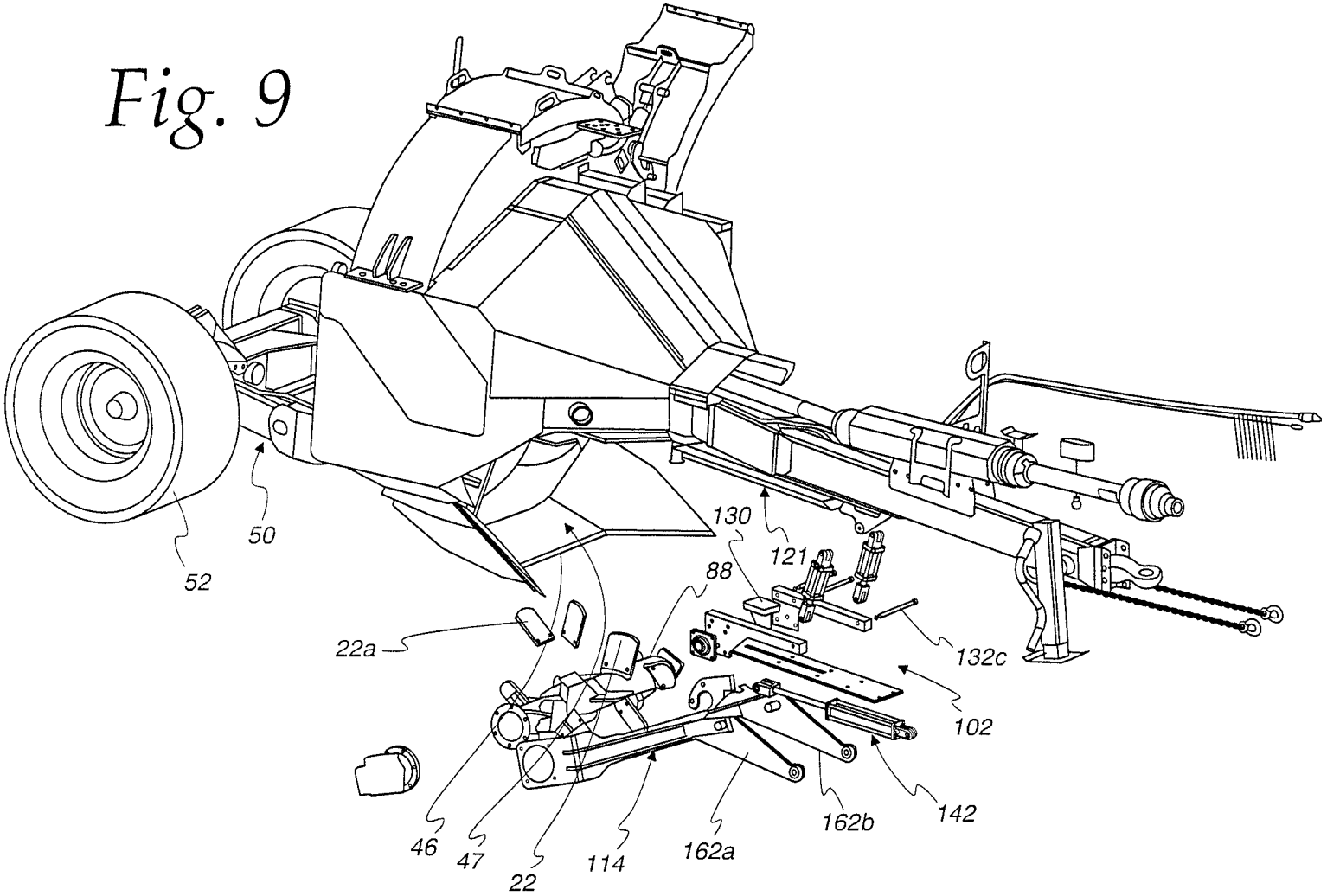
FIG. 9 is a view as in FIG. 8 but from a different perspective.

As seen most clearly in FIGS. 2, 3, and 7, the frame 12 is supported by the wheeled carriage 50 so that the parts 38, 40, 42, 44 cooperatively produce a forwardly opening cutting/shovel configuration declined towards and up to the leading cutting edge 46.

The subframe 54 is connected to the frame 12 for pivoting movement around a laterally extending axis 56 which thereby allows the vertical position of the wheels 52 relative to the frame 12 to be adjusted. An hydraulic cylinder/drive 58 acts between the frame 12 and subframe 54 to effect this adjustment. Extension of a piston rod 60 on the drive/cylinder 58 lowers the height of the wheels 52 relative to the frame 12, which increases a height of a portion of the frame 12, at which the first subassembly 16 is located, relative to a surface 62 of the subjacent ground 64. Since the front 24 of the ditch forming apparatus 10 is at a fixed height relative to the towing vehicle 30, this elevation also increases the angle of attack of the parts 38, 40, 42, 44 defining the cutting edge 46 while shallowing the ditch configuration.

The second subassembly 18 has a material dispersion unit at 66 made up of a first disk-shaped body 68 rotatable around an axis 70 through an extension 72 of the shaft 34 driven by the power takeoff 32. The body 68 has a plurality of reinforced blades/paddles 74 equidistantly spaced around the axis 70 with spaced, circumferentially facing surfaces 76.

The parts 38, 40, 42, 44 cooperatively funnel separated ground material to be picked up by the paddles 74 as the frame 10 is advanced in its operating path, following directional movement of the towing vehicle 30.

A shroud assembly 78 extends around the body 68 and defines a confined volume in which the separated ground material is centrifugally accelerated. The shroud assembly 78 is interrupted at a discharge opening 80 which can be selectively exposed by repositioning a hinged door 82. In the open position of FIG. 2, the door 82 defines a curved guide surface 84 which re-routes the escaping accelerated material pieces from a substantial vertical path arcuately outwardly in the direction of the arrow 86 in FIG. 2. The rotating speed and diameter of the component 68 dictate the particular trajectory of the discharging material.

The precise details of the primary ditch forming assembly 14 and the first and second subassemblies 16, 18, respectively thereon, are not critical to the present invention. The construction of the dispersing components may take many different forms, such as, but not limited to, that in the aforementioned prior art.

The ground treatment assembly 20 consists of a shaft 88 that supports the at least one ground engaging component 22. As noted above, the ground engaging component might be a single auger shape or one or more individual elements such as discrete paddles 22, as depicted for the specific form herein. The shaft 88 is turned around an axis 90 whereby the components/paddles 22 turn around the axis 90 upstream of the body 68. Each of the components/blades 22 has oppositely facing and substantially parallel, flat surfaces 92*a*, 92*b* residing in planes that are non-orthogonal to the axis 90. As depicted, there are multiple components/paddles 22 on each axial side of a lengthwise center line for the shaft 88, with the components/paddles 22 spaced from each other both axially and around the axis 90.

At the center of the shaft 88 are separate components/paddles 22*a* with oppositely facing surfaces 92*a*', 92*b*' that are substantially parallel, and each residing in a plane substantially parallel to the axis 90. The angular orientation of the surfaces 92*a*, 92*b* is such that as the shaft 88 is turned in one direction, as indicated by the arrow 94 in FIG. 10, the surfaces 92*a* intercept material and deflect the same axially inwardly from opposite ends of the shaft, as indicated by the arrows 96 in FIG. 10.

The surfaces 92*a*' pick up the accumulating material moved axially oppositely by the components/paddles 22 and with the same rotational action direct the intercepted ground material rearwardly towards the body 68 to be engaged by the paddles 74 as the body 68 is rotated.

The components/paddles 22, 22*a*, in addition to effectively funneling the ground material into the volume 47 bounded by the parts 38, 40, 42, 44, tend to break up the ground material for more effective and controlled propulsion by the paddles 74 on the body 68 as it rotates.

The different orientation of the components/paddles 22, 22*a* accounts for treatment and repositioning of the ground material in one manner and, as indicated above, is only exemplary in nature as virtually an unlimited number of variations in this structure might be devised to assist break-up and controlled repositioning of ground material to assist lateral distribution away from the ditch that is being formed.

The details of how the various components on the ditch forming apparatus 10 are driven are not critical to the present invention. As indicated, hydraulic operation of some or all of the moving components may be effected through a circuit pressured independently, through an hydraulic system associated with the towing vehicle 30, or through operation of the takeoff 32 on the towing vehicle 30. Accordingly, the driving components will be shown only schematically herein.

Figure 10:
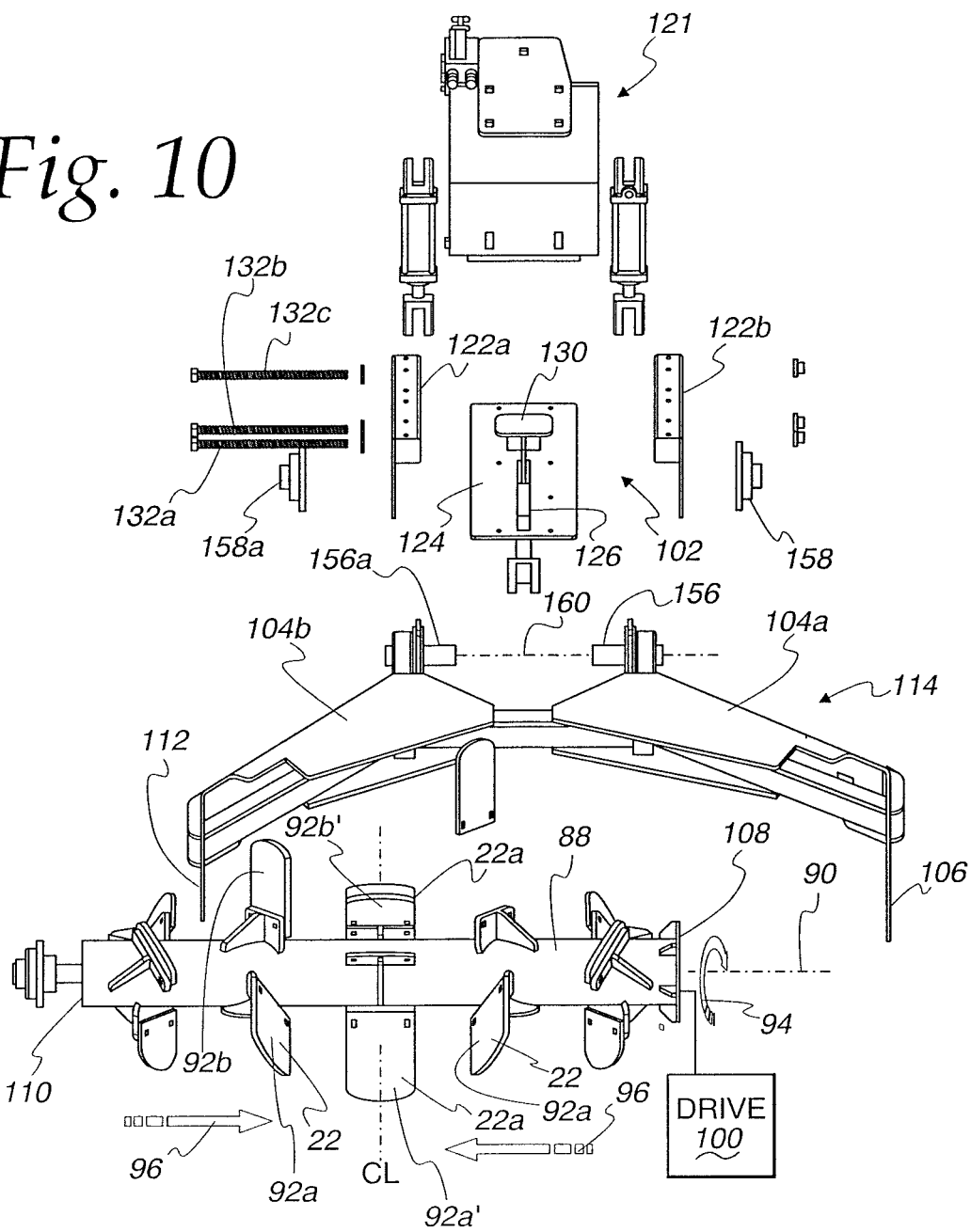
FIG. 10 is an exploded view of a ground treatment assembly on the ditch forming apparatus in FIGS. 2-9.
Figure 11:
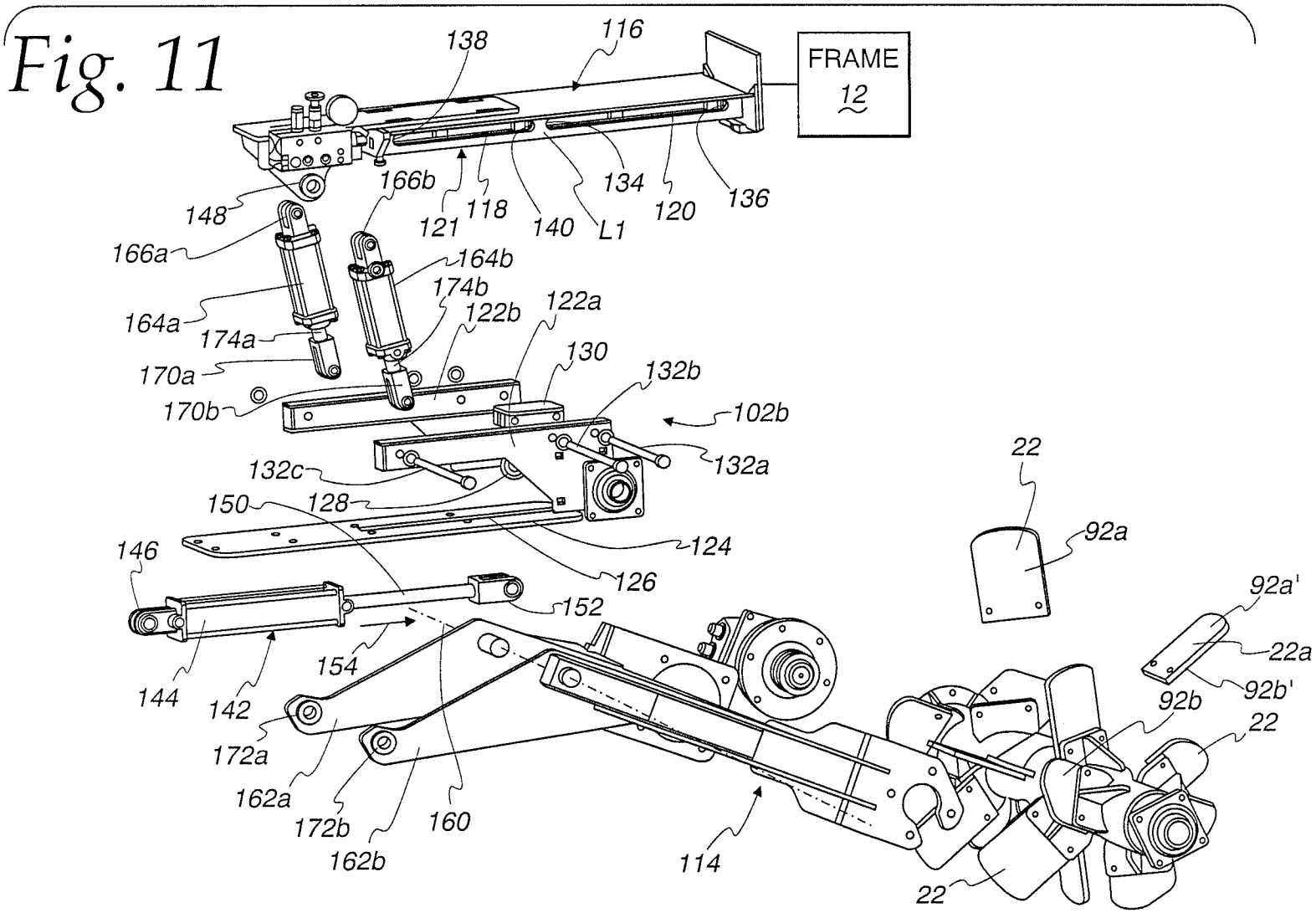
FIG. 11 is a view as in FIG. 10 but from a different perspective.
Figure 12:
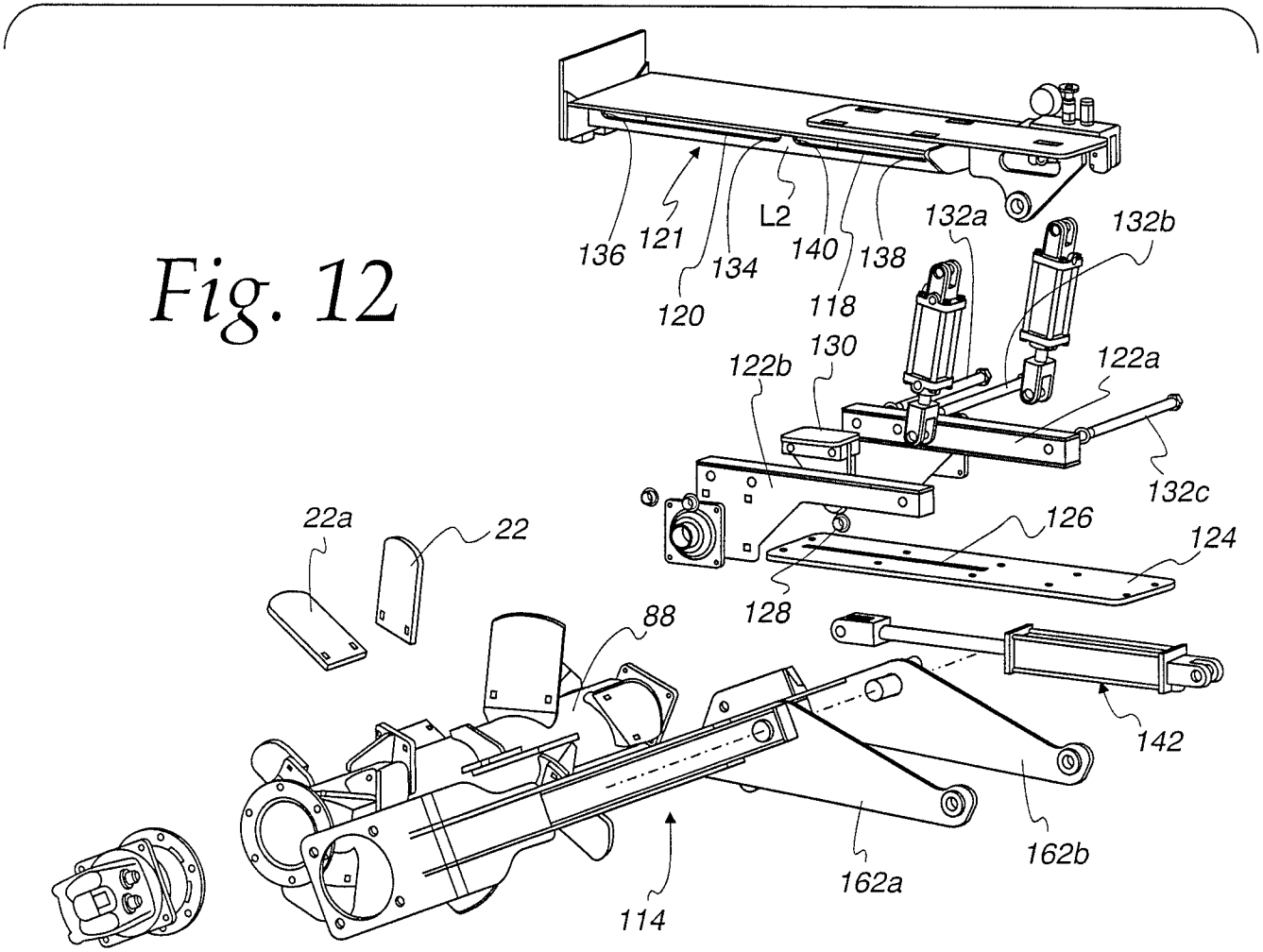
FIG. 12 is a view as in FIGS. 10 and 11 from a still further different perspective.
Figure 13:
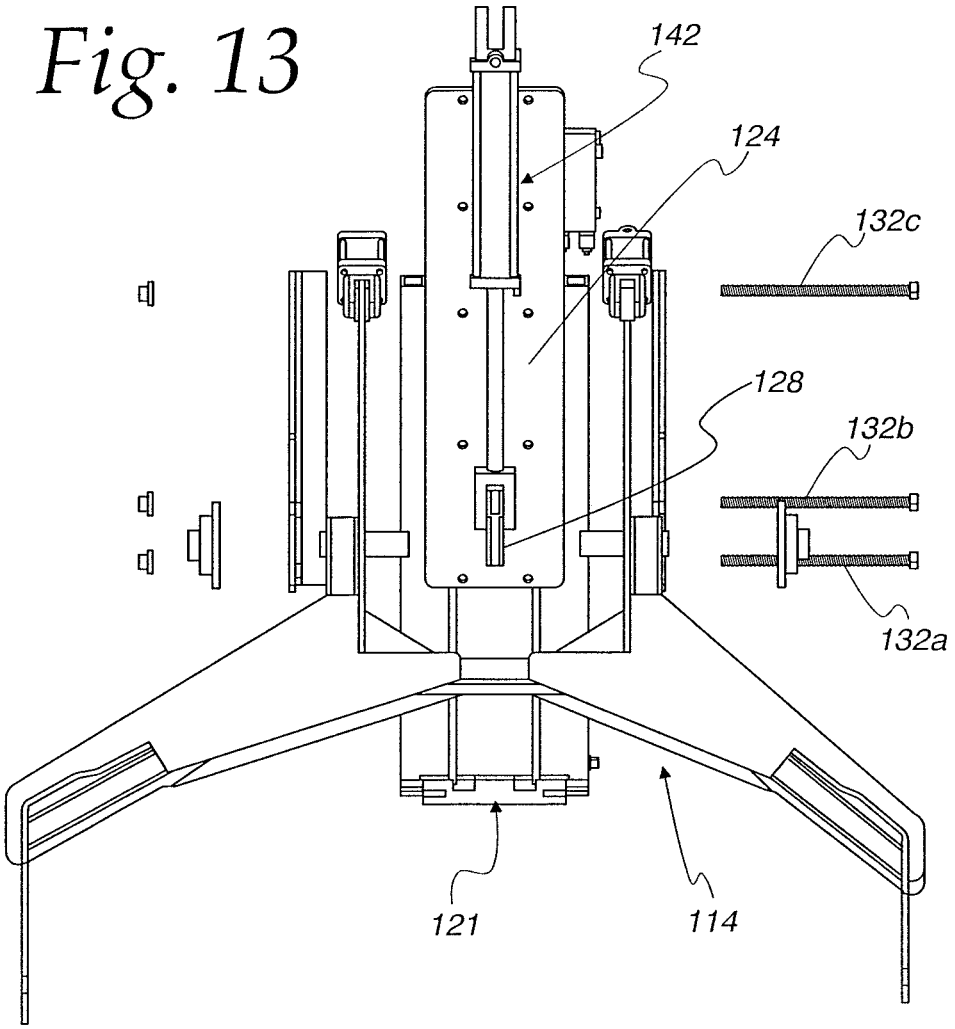
FIG. 13 is a bottom view of the components in FIGS. 10-12 in assembled relationship.

For example, in FIG. 10, the drive for the shaft is shown at 100 and is operable to turn the shaft around the axis 90 through either or both ends thereof. In one preferred form, the drive 100 is capable of turning the shaft 88 in opposite directions around the axis 90. Reversing the rotation from that described above may be desirable for different reasons, amongst which is the ability to break loose ground material that may have accumulated over extended operation and/or with wet or compacted ground material.

Further, the drive 100 is configured so that the shaft 88 may be driven independently of the rotating body 68 whereby relative turning speeds can be changed. In one form, the drive 100 may be controlled so that rotation of the shaft 88 is stopped while the body 68 continues rotating.

In this embodiment, a subframe 102 is provided that is connected to the frame 12 in a manner that the subframe 102 may move in a fore-and-aft direction guidingly relative to the frame 12 between separate predetermined positions.

In the depicted embodiment, the shaft 88 is connected to the subframe 102 through spaced arms 104*a*, 104*b* which are fixed together to define a unitary assembly. One of the arms 104*a* is connected through a plate 106 to one axial end 108 of the shaft 88, with the other arm 104*b* connected to the opposite axial end 110 of the shaft 88 through a separate plate 112. The joined arms 104*a*, 104*b* and shaft 88 define an arm assembly at 114. It should be noted that a single arm might be utilized to make up the arm assembly 114 or more than two arms might be utilized. As depicted, the arms 104*a*, 104*b* effectively function as a single arm.

The arm assembly 114 is connected to the subframe 102 that in turn is connected to a guide assembly 116, that is part of, or fixedly attached to, the frame 12, through which the subframe 102 is guided in a fore-and-aft direction relative to the frame 12.

The guide assembly 116 defines separate guide channels 118, 120, with each of the channels 118, 120 elongate and aligned in length in a fore-and-aft direction. The guide channels 118, 120 are defined on spaced legs L1, L2 of a downwardly opening U-shaped bracket 121 and have the same matched configuration on each such leg.

The bracket 121 resides between laterally spaced components 122*a*, 122*b* that are mirror images of each other.

A guide plate 124 resides between the components 122*a*, 122*b* and has an elongate slot 126 therein to receive a sliding component 128 depending from a base 130.

Three elongate guide rods 132*a*, 132*b*, 132*c* connect between the components 122*a*, 122*b* with two of the rods 132*a*, 132*b* extending through the base 130, located therebetween. The guide rods 132*a*, 132*b* extend through the guide channel 120 on each bracket leg L1, L2 and are guided therewithin in a fore-and-aft direction between a forwardmost position for the subframe 102, wherein the guide rod 132*b* abuts to separate stops 134 on the guide assembly 116, and a rearwardmost position wherein the guide rod 132*a* abuts separate stops 136 on the guide assembly 116.

The guide rod 132*c* moves guidingly within the guide channel 118 on each bracket leg L1, L2 in a range dictated by forward stops 138 and rearward stops 140.

With the components 122*a*, 122*b*, base 130, and guide plate 124 connected to the guide assembly 116, the sliding component 128 projects through the slot 126 to below the guide plate 124.

An hydraulic cylinder 142 has a barrel 144 with an end fitting 146 pivotably connected to a mount 148 on the frame 12/guide assembly 116. A piston rod 150 has an end fitting 152 pivotably connected to the sliding component 128. By extending the piston rod 150 in the direction of the arrow 154 in FIG. 11, the subframe 102, consisting of those components moving between the guide assembly 116 and the guide plate 124, are guidingly advanced as a unit rearwardly in the direction of the arrow 154.

The range of movement of the subframe 102, between forwardmost and rearwardmost positions, is determined by the fore-and-aft lengths of the guide channels 118, 120 and the interaction of the rods 132*a*, 132*b*, 132*c* therewithin.

Of course, the range of fore-and-aft movement of the subframe 102 may be controlled by setting appropriate operating limits for the hydraulic cylinder 142, with the mechanical stops for the rods 132 being unnecessary or made available for redundancy or safety.

The arm assembly 114 is connected to the subframe 102 through separate pivot connections at laterally spaced locations. One of the pivot connections consists of a stub shaft 156 on the arm assembly that is supported for rotation within a bushing 158 on the subframe 102. A like stub shaft 156*a* engages a bushing 158*a*. Accordingly, the arm assembly 114 is mounted to the subframe 102 for pivoting movement relative thereto around a laterally extending axis 160.

In the depicted embodiment, the pivot connections at the location of the stub shafts 156, 156*a* define a fulcrum about which the arm assembly 114 pivots. The arms 104*a*, 104*b* have extensions 162*a*, 162*b*, respectively, projecting forwardly of the fulcrum location/axis 160 and are movable to permit controlled pivoting of the arm assembly 114.

In this embodiment, a pair of hydraulic cylinders 164*a*, 164*b* function as drives for pivoting the arm assembly 114 around the axis 160. Barrel connectors 166*a*, 166*b* on the cylinders 164*a*, 164*b* respectively, are pivotably connected to mounts 168*a*, 168*b* on the frame 12, Piston rod end fittings 170*a*, 170*b* are respectively pivotably connected at mounts 172*a*, 172*b* on the arm extensions 162*a*, 162*b*.

In the depicted embodiment, the axis 70 of the body 68 resides above the shaft axis 90, as viewed from above the ditch forming apparatus 10. While the invention contemplates that the vertical spacing between the axes 70, 90 could be fixed, the above described structure allows pivoting of the arm assembly 114 which raises and lowers the shaft 88 through an arcuate path, centered on the axis 160.

Accordingly, the depth of penetration of the components 22 can be selectively changed by operating the cylinders/drives 164*a*, 164*b*. As noted above, this capability allows the depth to be selected based upon the nature of the ground material and its particular condition. Further, the pivoting range, dictated primarily by the extension of piston rods 174*a*, 174*b* on the cylinders/drives 164*a*, 164*b*, may allow the components 22 to be raised to be effectively above the subjacent ground material that may be encountered or broken loose in operation.

In one exemplary mode of operation, the shaft 88 may be pivoted upwardly and its rotation interrupted whereby the components 22 are staged to perform no significant function.

Further, the ability to pivot the shaft 88 allows the operator to create a clearance volume between the shaft 88 with the associate components 22 and the downstream portion of the ditch forming assembly 10 at which components may need to be accessed for maintenance or repair, and/or cleaning of accumulated material may be required at an otherwise inaccessible location.

While the movable subframe 102 is desirable for reasons set forth below, it is also contemplated that the arm assembly, the same as the arm assembly 114 or modified as shown at 114' in FIG. 15, might be connected directly to the frame 12' for relative movement.

Figure 15:
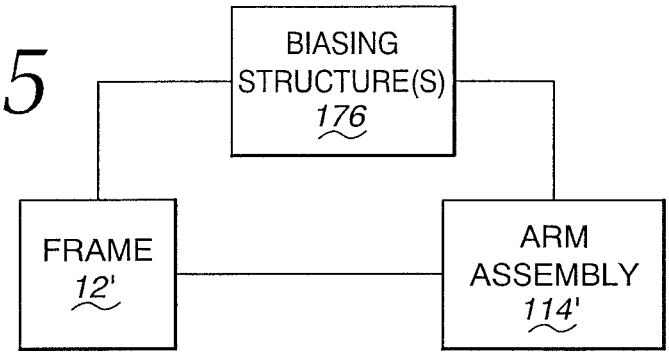
FIG. 15 is a schematic representation of a biasing structure for an arm assembly that is part of the ground treatment assembly on the inventive ditch forming apparatus.

Further, as an alternative to utilizing hydraulic cylinders, other forms of biasing structures, as shown schematically at 176 in FIG. 15, might be used to act between the frame 12' and arm assembly 114' to produce a biasing force in either upward or downward directions. The biasing structure 176 might be incorporated into the arm assembly 114 as described above.

As noted previously, the hydraulic cylinder/drive 142 allows the subframe 102 to be translated in a fore-and-aft direction, which thereby causes the arm assembly 114 to follow this movement. Accordingly, the fore-and-aft relationship between the shaft 88 and components 22 on the arm assembly 114 and the downstream portion of the ditch forming apparatus 10 can be changed within a range controlled by the interacting rods 132*a*, 132*b*, 132*c* and channels 118, 120.

As noted in the Background portion herein, certain ground conditions may make it desirable to shift the shaft 88 and associated components 22 rearwardly into closer proximity to the volume 47, whereas repositioning of certain agricultural debris may dictate a more forward positioning to have optimal performance.

Figure 16:
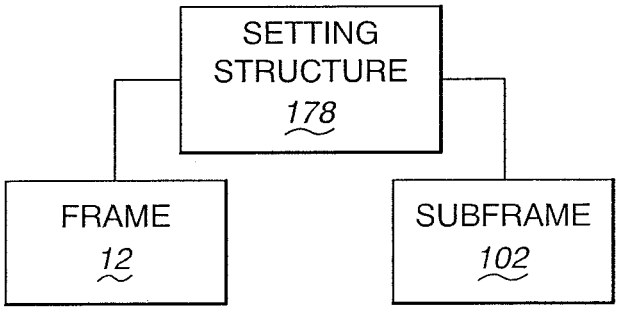
FIG. 16 is a schematic representation of an adjustable setting structure for controlling location of a subframe on the inventive ground treatment assembly relative to a main frame.

While the ability to reposition the arm assembly 114 during operation, as through the cylinders/drive 142 is desirable, it is contemplated that any other type of setting structure, as shown schematically at 178 in FIG. 16, might cooperate between the frame 12 and subframe 102 to maintain any position within a desired range. For example, the setting structure 178 may include a turn buckle that can be preset at the start of an operation and potentially changed by manually manipulating the turn buckle.

Figure 17:
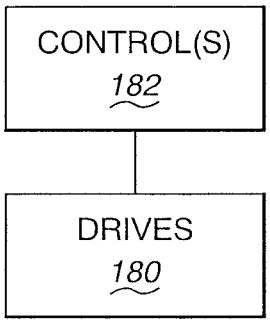
FIG. 17 is a schematic representation of a control system for one or more drives for components on the inventive ditch forming apparatus.

The invention contemplates that all of the movable components that are repositioned may be operated through a dedicated drive or drives that are coordinated, with the drives collectively shown schematically in FIG. 17 at 180. One or more controls 182 may be provided to independently operate the drives 180 or to have a coordinated operation therebetween. As noted, the hydraulically operated components, described above, are exemplary in nature only, as any type of drive from any power supply or supplies, as shown at 36 in FIG. 2, is contemplated.

The foregoing disclosure of specific embodiments is intended to be illustrative of the broad concepts comprehended by the invention.

The invention claimed is:

1. A ditch forming apparatus having a front and rear and comprising:

a frame;

a primary ditch forming assembly on the frame and comprising: a) a first subassembly for penetrating and separating subjacent ground material; and b) a second subassembly for directing separated subjacent ground material away from a ditch formed by the primary ditch forming assembly as the frame is advanced in an operating path; and a ground treatment assembly on at least one of the frame and primary ditch forming assembly configured to facilitate delivery of separated subjacent ground material to the second subassembly, the ground treatment assembly comprising at least one ground engaging component that is turned around a first axis to thereby cause the at least one ground engaging component to treat subjacent ground material delivered to the second subassembly, wherein the ditch forming apparatus is configured so that at least one of: a) a vertical height of the first axis relative to the frame can be changed; b) a variable vertical force generated between the at least one ground engaging component and frame can be changed; c) a fore and aft position of the first axis relative to the frame can be changed; d) a speed of turning of the at least one ground engaging component around the first axis can be changed; and e) a direction of turning of the at least one ground engaging component around the first axis can be changed, wherein the ditch forming apparatus comprises a shaft on which the at least one ground engaging component is located and a drive for turning the shaft around the first axis wherein the second subassembly comprises a first body rotatable around a second axis and having a plurality of blades that direct separated subjacent ground material away from the ditch formed by the primary ditch forming assembly as the frame is advanced in the operating path, wherein the ditch forming apparatus is configured to change a speed of turning the shaft around the first axis relative to a speed of rotation of the first body around the second axis.

2. The ditch forming apparatus according to claim 1 wherein the at least one ground engaging component is configured to laterally advance engaged ground material as the shaft turns around the first axis.

3. The ditch forming apparatus according to claim 1 wherein the at least one ground engaging component is configured to reposition separated subjacent ground material delivered to the second subassembly.

4. The ditch forming apparatus according to claim 3 wherein the shaft is mounted on a subframe, the subframe is mounted for guided movement relative to the frame over a range between a first position and a second position, wherein a fore and aft location of the shaft relative to the frame changes as the subframe moves between the first and second positions.

5. The ditch forming apparatus according to claim 4 wherein a drive acts between the frame and subframe and is operable to change the subframe between the first and second positions.

6. The ditch forming apparatus according to claim 5 wherein the drive is an hydraulic drive.

7. The ditch forming apparatus according to claim 3 wherein the shaft is connected to at least one arm whereby the shaft and the at least one arm make up an arm assembly, the arm assembly pivotably connected to at least one of: a) the frame;

and b) a subframe on the frame for movement around another axis in a range between first and second positions, the shaft at a first height relative to the frame with the shaft assembly in its first position and at a second height relative to the frame that is different than the first height with the shaft assembly in its second position.

8. The ditch forming apparatus according to claim 7 wherein a drive acts between at least one of the frame and subframe and the arm assembly and is operable to change the arm assembly between its first and second positions.

9. The ditch forming apparatus according to claim 8 wherein the drive is an hydraulic drive.

10. The ditch forming apparatus according to claim 8 wherein the drive is operable to act against the arm assembly to cause a variable downward force to be generated between the at least one ground engaging component and ground material as the ditch forming apparatus is operated.

11. The combination according to claim 7 wherein a force applying structure acts between at least one of the frame and subframe and the arm assembly to thereby bias the at least one ground engaging component downwardly against subjacent ground material.

12. A ditch forming apparatus having a front and rear and comprising:

a frame;

a primary ditch forming assembly on the frame and comprising: a) a first subassembly for penetrating and separating subjacent ground material; and b) a second subassembly for directing separated subjacent ground material away from a ditch formed by the primary ditch forming assembly as the frame is advanced in an operating path; and a ground treatment assembly on at least one of the frame and primary ditch forming assembly configured to facilitate delivery of separated subjacent ground material to the second subassembly, the ground treatment assembly comprising at least one ground engaging component that is turned around a first axis to thereby cause the at least one ground engaging component to treat subjacent ground material delivered to the second subassembly, wherein the ditch forming apparatus is configured so that at least one of: a) a vertical height of the first axis relative to the frame can be changed; b) a variable vertical force generated between the at least one ground engaging component and frame can be changed; c) a fore and aft position of the first axis relative to the frame can be changed; d) a speed of turning of the at least one ground engaging component around the first axis can be changed; and e) a direction of turning of the at least one ground engaging component around the first axis can be changed, wherein the second subassembly comprises a first body rotatable around a second axis and a plurality of blades on the body spaced radially from the second axis that direct ground material separated by the first subassembly laterally away from a ditch generated by the ditch forming apparatus as the frame is advanced in the operating path.

13. The ditch forming apparatus according to claim 12 wherein the second axis extends in a fore and aft direction and resides above the first axis where the first and second axis cross as viewed from above the ditch forming apparatus.

14. The ditch forming apparatus according to claim 12 wherein the ditch forming apparatus comprises a drive for turning the shaft around the first axis, the drive configured so that a speed of turning the shaft around the first axis can be changed whereby the speed of turning the shaft around the first axis can be changed with the body rotating around the second axis at a constant same speed.

15. The ditch forming apparatus according to claim 14 wherein the ditch forming apparatus is configured so that the drive can be controlled so that the shaft is not turned around the first axis with the body continuing to turn around the second axis.

16. The ditch forming apparatus according to claim 12 in combination with a towing vehicle for the frame and having a power takeoff, the ditch forming apparatus comprising at least one drive for turning the shaft around the first axis and the body around the second axis, and the at least one drive is an hydraulic drive operated through the power takeoff on the towing vehicle.

17. The ditch forming apparatus according to claim 1 wherein the ditch forming apparatus comprises a drive for turning the shaft around the first axis, the drive configured to selectively turn the first shaft in opposite directions around the first axis.

18. The ditch forming apparatus according to claim 1 in combination with a vehicle for towing the ditch forming apparatus and thereby causing the frame to be advanced in the operating path.

19. The combination according to claim 18 wherein the frame is supported on at least one wheel and the wheel is mounted movably relative to the frame so that a height of a portion of the frame at which the first subassembly is located can be changed relative to subjacent ground on which the ditch forming apparatus is supported.

20. A ditch forming apparatus having a front and rear and comprising:

a frame;

a primary ditch forming assembly on the frame and comprising: a) a first subassembly for penetrating and separating subjacent ground material; and b) a second subassembly for directing separated subjacent ground material away from a ditch formed by the primary ditch forming assembly as the frame is advanced in an operating path; and a ground treatment assembly on at least one of the frame and primary ditch forming assembly configured to facilitate delivery of separated subjacent ground material to the second subassembly, the ground treatment assembly comprising at least one ground engaging component that is turned around a first axis to thereby cause the at least one ground engaging component to treat subjacent ground material delivered to the second subassembly, wherein the ditch forming apparatus is configured so that at least one of: a) a vertical height of the first axis relative to the frame can be changed; b) a variable vertical force generated between the at least one ground engaging component and frame can be changed; c) a fore and aft position of the first axis relative to the frame can be changed; d) a speed of turning of the at least one ground engaging component around the first axis can be changed; and e) a direction of turning of the at least one ground engaging component around the first axis can be changed, wherein the ground treatment assembly comprises a shaft supporting the at least one ground engaging component and movable around the first axis and the at least one ground engaging component is configured to reposition separated subjacent ground material delivered to the second subassembly, wherein the shaft is mounted on a subframe, the subframe is mounted for guided movement relative to the frame over a range between a first position and a second position, wherein a fore and aft location of the shaft relative to the frame changes as the subframe moves between the first and second positions.

21. A ditch forming apparatus having a front and rear and comprising:

a frame;

a primary ditch forming assembly on the frame and comprising: a) a first subassembly for penetrating and separating subjacent ground material; and b) a second subassembly for directing separated subjacent ground material away from a ditch formed by the primary ditch forming assembly as the frame is advanced in an operating path; and a ground treatment assembly on at least one of the frame and primary ditch forming assembly configured to facilitate delivery of separated subjacent ground material to the second subassembly, the ground treatment assembly comprising at least one ground engaging component that is turned around a first axis to thereby cause the at least one ground engaging component to treat subjacent ground material delivered to the second subassembly, wherein the ditch forming apparatus is configured so that at least one of: a) a vertical height of the first axis relative to the frame can be changed; b) a variable vertical force generated between the at least one ground engaging component and frame can be changed; c) a fore and aft position of the first axis relative to the frame can be changed; d) a speed of turning of the at least one ground engaging component around the first axis can be changed; and e) a direction of turning of the at least one ground engaging component around the first axis can be changed, wherein the ground treatment assembly comprises a shaft supporting the at least one ground engaging component and movable around the first axis and the at least one ground engaging component is configured to reposition separated subjacent ground material delivered to the second subassembly, wherein the shaft is connected to at least one arm whereby the shaft and the at least one arm make up an arm assembly, the arm assembly pivotably connected to at least one of: a) the frame; and b) a subframe on the frame for movement around another axis in a range between first and second positions, the shaft at a first height relative to the frame with the shaft assembly in its first position and at a second height relative to the frame that is different than the first height with the shaft assembly in its second position.

22. A ditch forming apparatus having a front and rear and comprising:

a frame;

a primary ditch forming assembly on the frame and comprising: a) a first subassembly for penetrating and separating subjacent ground material; and b) a second subassembly for directing separated subjacent ground material away from a ditch formed by the primary ditch forming assembly as the frame is advanced in an operating path; and a ground treatment assembly on at least one of the frame and primary ditch forming assembly configured to facilitate delivery of separated subjacent ground material to the second subassembly, the ground treatment assembly comprising at least one ground engaging component that is turned around a first axis to thereby cause the at least one ground engaging component to treat subjacent ground material delivered to the second subassembly, wherein the ditch forming apparatus is configured so that at least one of: a) a vertical height of the first axis relative to the frame can be changed; b) a variable vertical force generated between the at least one ground engaging component and frame can be changed; c) a fore and aft position of the first axis relative to the frame can be changed; d) a speed of turning of the at least one ground engaging component around the first axis can be changed; and e) a direction of turning of the at least one ground engaging component around the first axis can be changed, wherein the ditch forming apparatus comprises a drive for turning the shaft around the first axis, the drive configured to selectively turn the first shaft in opposite directions around the first axis.

* * * * *